US008863833B2

(12) United States Patent
Mescall et al.

(10) Patent No.: US 8,863,833 B2
(45) Date of Patent: Oct. 21, 2014

(54) MULTI-POINT INJECTION SYSTEM FOR OILFIELD OPERATIONS

(75) Inventors: Stephen Mescall, Kilrush (IE); Matthew C. Stone, Broussard, LA (US); Louis F. LaFleur, Cypress, TX (US); James Joseph Freeman, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 748 days.

(21) Appl. No.: 12/475,303

(22) Filed: May 29, 2009

(65) Prior Publication Data

US 2009/0294123 A1 Dec. 3, 2009

Related U.S. Application Data

(60) Provisional application No. 61/058,439, filed on Jun. 3, 2008.

(51) Int. Cl.

| | |
|---|---|
| ***E21B 43/12*** | (2006.01) |
| ***E21B 34/08*** | (2006.01) |
| ***E21B 34/06*** | (2006.01) |
| ***E21B 41/00*** | (2006.01) |

(52) U.S. Cl.

CPC ..... *E21B 41/0078* (2013.01); *E21B 34/063* (2013.01); *E21B 43/12* (2013.01)

USPC ..... 166/222; 166/250.07; 166/263; 166/269; 166/305.1

(58) Field of Classification Search

CPC .... E21B 41/0078; E21B 43/12; E21B 43/162

USPC ..... 166/313, 305.1, 297, 55.1, 265, 105.5, 166/106, 372, 222, 66, 250.07, 263, 269, 166/191, 205

See application file for complete search history.

(56) References Cited

U.S. PATENT DOCUMENTS 1,379,815 A * 5/1921 Hall ..... 166/146
3,211,225 A 10/1965 Thiessen et al.

(Continued)

FOREIGN PATENT DOCUMENTS

WO 9850680 A2 11/1998
WO 9857030 A1 12/1998

(Continued)

OTHER PUBLICATIONS

Written Opnion of the ISA for PCT/US2009/045889.*

*Primary Examiner* — Kenneth L Thompson
(74) *Attorney, Agent, or Firm* — Mossman, Kumar & Tyler PC

(57) ABSTRACT

A system monitors and controls the injection of additives into formation fluids recovered through a well may include a plurality of nozzles that receive the injection fluid from an umbilical disposed in a well. Each nozzle may have an associated flow control element that is configured to affect a flow of the injection fluid ejected through the associated nozzle. The umbilical may include one or more filters positioned in a first of two parallel conduits formed along the umbilical. An occlusion member restricts in a second of the two conduits. The occlusion member permits flow in the second conduit after a predetermined pressure differential exists in the second conduit. The system may include a plurality of pressure sensors disposed along the umbilical, and an injector unit that dispenses fluid into the umbilical. A controller operatively coupled to the injector unit operates the injector in response to measurements from the pressure sensors.

18 Claims, 4 Drawing Sheets

(56) References Cited

U.S. PATENT DOCUMENTS

| | | | | |
|---|---|---|---|---|
| 3,710,867 | A | 1/1973 | Bansbach | |
| 4,064,936 | A | 12/1977 | McClure | |
| 4,160,734 | A | 7/1979 | Taylor et al. | |
| 4,258,787 | A | 3/1981 | Amancharla | |
| 4,284,143 | A | 8/1981 | Scherrer et al. | |
| 4,354,553 | A | 10/1982 | Hensley | |
| 4,375,833 | A | 3/1983 | Meadows | |
| 4,436,148 | A | 3/1984 | Maxwell | |
| 4,566,536 | A | 1/1986 | Holmes | |
| 4,580,952 | A | 4/1986 | Eberle | |
| 4,582,131 | A | 4/1986 | Plummer et al. | |
| 4,605,062 | A | 8/1986 | Klumpyan et al. | |
| 4,635,723 | A | 1/1987 | Spivey | |
| 4,648,457 | A | 3/1987 | Ross et al. | |
| 4,665,981 | A | 5/1987 | Hayatdavoudi | |
| 4,721,158 | A | 1/1988 | Merritt, Jr. et al. | |
| 4,747,451 | A | 5/1988 | Adams, Jr. et al. | |
| 4,830,112 | A | 5/1989 | Erickson | |
| 4,832,121 | A | 5/1989 | Anderson | |
| 4,843,247 | A | 6/1989 | Yamazoe et al. | |
| 4,901,563 | A | 2/1990 | Pearson | |
| 4,907,857 | A | 3/1990 | Giuliani et al. | |
| 4,974,929 | A | 12/1990 | Curry | |
| 5,059,790 | A | 10/1991 | Klainer et al. | |
| 5,098,659 | A | 3/1992 | Yim et al. | |
| 5,115,811 | A | 5/1992 | Hartlaub et al. | |
| 5,147,561 | A | 9/1992 | Burge et al. | |
| 5,172,717 | A | 12/1992 | Boyle et al. | |
| 5,209,301 | A | 5/1993 | Ayres | |
| 5,285,715 | A | 2/1994 | Elrod, Jr. et al. | |
| 5,307,146 | A | 4/1994 | Porter et al. | |
| 5,335,730 | A | 8/1994 | Cotham, III | |
| 5,353,237 | A | 10/1994 | Bass et al. | |
| 5,359,681 | A | 10/1994 | Jorgenson et al. | |
| 5,413,175 | A | 5/1995 | Edmunds | |
| 5,418,614 | A | 5/1995 | Brost et al. | |
| 5,517,593 | A | 5/1996 | Nenniger et al. | |
| 5,569,838 | A | 10/1996 | Broedel et al. | |
| 5,570,437 | A | 10/1996 | Kluth et al. | |
| 5,590,958 | A | 1/1997 | Dearing, Sr. et al. | |
| 5,672,515 | A | 9/1997 | Furlong | |
| 5,706,896 | A | 1/1998 | Tubel et al. | |
| 5,714,121 | A | 2/1998 | Alderete et al. | |
| 5,735,346 | A | 4/1998 | Brewer | |
| 5,747,348 | A | 5/1998 | Jaduszliwer et al. | |
| 5,829,520 | A | 11/1998 | Johnson | |
| 5,872,876 | A | 2/1999 | Kluth et al. | |
| 5,937,946 | A | 8/1999 | Streetman | |
| 5,992,230 | A | 11/1999 | Scarpa et al. | |
| 5,992,250 | A | 11/1999 | Kluth et al. | |
| 6,006,828 | A | 12/1999 | Kluth et al. | |
| 6,006,832 | A | 12/1999 | Tubel et al. | |
| 6,022,748 | A | 2/2000 | Charych et al. | |
| 6,026,847 | A | 2/2000 | Reinicke et al. | |
| 6,125,938 | A | 10/2000 | Garcia-Soule et al. | |
| 6,138,758 | A | 10/2000 | Shaw et al. | |
| 6,257,332 | B1 | 7/2001 | Vidrine et al. | |
| 6,491,098 | B1 * | 12/2002 | Dallas | 166/297 |
| 6,851,444 | B1 | 2/2005 | Kohl et al. | |
| 7,234,524 | B2 | 6/2007 | Shaw et al. | |
| RE40,308 | E | 5/2008 | Hamilton et al. | |
| 7,377,322 | B2 * | 5/2008 | Hofman | 166/313 |
| 7,389,787 | B2 | 6/2008 | Means et al. | |
| 7,464,752 | B2 * | 12/2008 | Dale et al. | 166/227 |
| 2003/0051876 | A1 | 3/2003 | Tolman et al. | |
| 2003/0056952 | A1 * | 3/2003 | Stegemeier et al. | 166/250.12 |
| 2004/0043501 | A1 | 3/2004 | Means et al. | |
| 2004/0177951 | A1 * | 9/2004 | Hoffman et al. | 166/117.5 |
| 2005/0150552 | A1 | 7/2005 | Forshey | |
| 2006/0107978 | A1 | 5/2006 | Saik | |
| 2008/0110629 | A1 * | 5/2008 | Belew et al. | 166/298 |

FOREIGN PATENT DOCUMENTS

| | | | |
|---|---|---|---|
| WO | 00/01925 | A1 | 1/2000 |
| WO | 03/023181 | A1 | 3/2003 |

* cited by examiner

MULTI-POINT INJECTION SYSTEM FOR OILFIELD OPERATIONS

CROSS-REFERENCE TO RELATED APPLICATIONS

This application claims priority from U.S. Provisional Patent Application Ser. No. 61/058,439 filed, Jun. 3, 2008.

BACKGROUND OF THE DISCLOSURE

1. Field of the Disclosure

This disclosure relates generally to oilfield operations and more particularly to an additive injection and fluid processing systems and methods.

2. Background of the Art

During hydrocarbon recovery operations, production tubing, pipelines, valves and related equipment may be exposed to substances that corrode, degrade or otherwise reduce their efficiency or service life. Thus, it may be advantageous to treat such equipment with corrosion inhibitors, scale inhibitors, paraffin inhibitors, hydrate inhibitors, demulsifiers, and the like, and mixtures thereof. The present disclosure provides, in part, enhanced additive injection systems and methods suitable for such uses.

SUMMARY OF THE DISCLOSURE

In aspects, the present disclosure provides a system for injecting an injection fluid in a well. The system may include a plurality of nozzles that receive the injection fluid from an umbilical disposed in a well. Each nozzle may have an associated flow control element that affects, influences, adjusts or otherwise controls a flow of the injection fluid ejected through the associated nozzle. In embodiments, the umbilical may include one or more filters. In one embodiment, a filter element may be positioned in a first of two parallel conduits formed along the umbilical. An occlusion member configured to restrict flow may be positioned in a second of the two conduits. The occlusion member may selectively restrict flow in the second conduit after a predetermined pressure differential exists in the second conduit. In further embodiments, the system may include a plurality of pressure sensors disposed along the umbilical, and an injector unit that dispenses fluid into the umbilical. A controller operatively coupled to the injector unit operates the injector in response to measurements from the pressure sensors.

In aspects, the present disclosure provides a method for injecting an injection fluid in a well. The method may include conveying injection fluid into the well using an umbilical that conveys the injection fluid, and injecting the injection fluid into two or more zones using nozzles. The method may include configuring the nozzles to receive the injection fluid from the umbilical; and affecting a flow parameter of the fluid in the nozzles using a flow control element associated with each nozzle. In aspects, the method may include filtering the fluid in the umbilical using one or more filters.

In aspects, the present disclosure provides a system for injecting an injection fluid in a well. The system may include an umbilical to convey the injection fluid in the well; a plurality of nozzles that receive the injection fluid from the umbilical; and a flow control element associated with each nozzle. Each flow control element may control a flow of the injection fluid through the associated nozzle.

In aspects, the present disclosure provides a method for injecting an injection fluid in a well. The method may include conveying the injection fluid into the well using an umbilical; ejecting the injection fluid into the well using a plurality of nozzles; and controlling the flow of the injection fluid through each nozzle using a flow control element associated with each nozzle.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the one mode embodiments, taken in conjunction with the accompanying drawings, in which like elements have been given like numerals, wherein.

DETAILED DESCRIPTION OF THE DISCLOSURE

Figure 1:
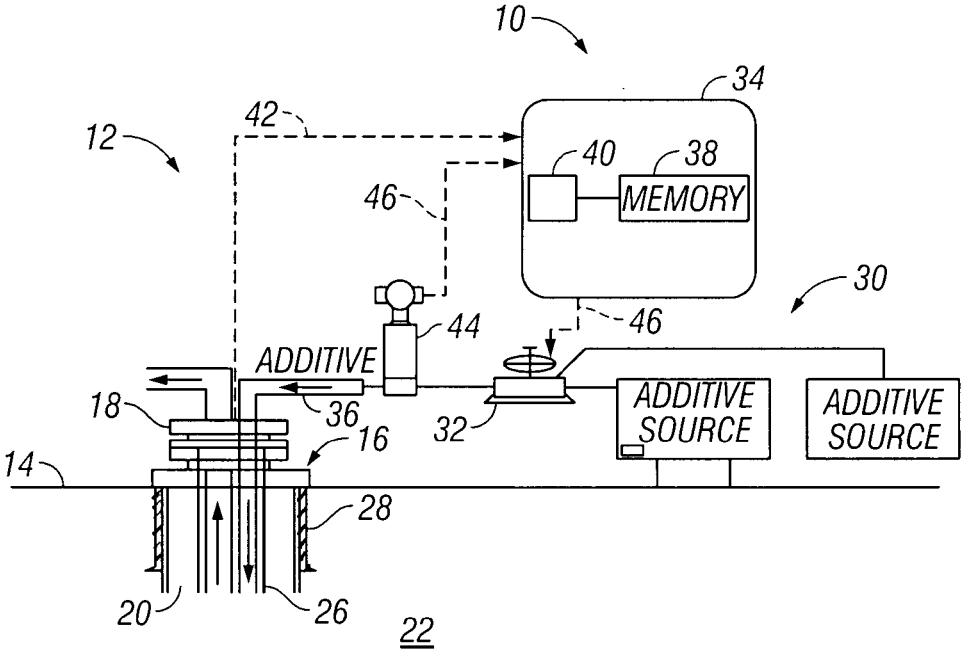
FIG. 1 schematically illustrates one embodiment of the surface components of an additive injection and monitoring system made according to the present disclosure.

Referring initially to FIG. 1, there is schematically shown one embodiment of an additive injection and monitoring system 10 (hereafter "system 10") made in accordance with the present disclosure. The system 10 may be deployed in conjunction with a facility 12 located at a surface 14 that services one or more production wells 16. While a land well is shown, it should be appreciated that the teachings of the present disclosure may be applied to offshore operations that service subsea wells. Conventionally, each well 16 includes a well head 18 and related equipment positioned over a wellbore 20 formed in a subterranean formation 22. The well bore 20 may have one or more production zones 24A-D (FIG. 2) for draining hydrocarbons from the formation 22 (FIG. 2) ("produced fluids" or "production fluid"). A production tubular 26 may be used to convey the fluid from the production zones to the wellhead 18. The production well 16 usually includes a casing 28 near the surface 14. The wellhead 18 may include equipment such as a blowout preventer stack and valves for controlling fluid flow to the surface 14. Wellhead equipment and production well equipment are well known and thus are not described in greater detail.

The system 10 may be utilized to introduce or inject a variety of chemicals or additives into the production well 16 to control, among other things, corrosion, scale, paraffin, emulsion, hydrates, hydrogen sulfide, asphaltenes, inorganics and other harmful substances. As used herein, the term "additive" generally refers to an engineered fluid that is formulated to perform a desired task. The additive(s) may be mixed with a base fluid such as water or oil to form what will hereafter be referred to as "injection fluid(s)." Injection fluid(s) may include liquids and/or gases. The system 10 may be configured to supply precise amounts of an additive or a mixture of additives to prevent, mitigate or otherwise lessen the harm caused by these substances. The system 10 may also be configured to periodically or continuously monitor the actual amount of the additives being dispensed, determine the effectiveness of the dispensed additives, and vary the amount of dispense additives as needed to maintain one or more parameters of interest within predetermined ranges or at specified values.

It should be understood that relatively small amount of additives are injected into the production fluid during operation. Accordingly, considerations such as precision in dispensing additives may be more relevant than mere volumetric capacity. In embodiments, the flow rate for an additive injected using the present disclosure may be at a rate such that the additive is present at a concentration of from about 1 parts per million (ppm) to about 10,000 ppm in the fluid being treated. In other embodiments, the flow rate for an additive injected using the present disclosure may be at a rate such that the additive is present at a concentration of from about 1 ppm to about 500 ppm in the fluid being treated.

In one embodiment, the system 10 may include an additive supply unit 30, an injector unit 32, and a controller 34. The system 10 may direct the injection fluid into an umbilical 36 disposed inside or outside of the production tubular 26. The additive supply unit 30 may include multiple tanks for storing different chemicals and one or more pumps for pumping the additives. This supply of additives may be continuous or intermittent. The injector unit 32 selectively injects these additives into the production fluid. The injector unit 32 may be a pump such as a positive displacement pump, a centrifugal pump, a piston-type pump, or other suitable device for pumping fluid. The controller 34 may be configured to control the additive injection process by, in part, controlling the operation of the additive supply unit 30 and the injector unit 32. The controller 34 may control operations by utilizing programs stored in a memory 38 associated with the controller 34. The controller 34 may include a microprocessor 40 may have a resident memory, which may include read only memories (ROM) for storing programs, tables and models, and random access memories (RAM) for storing data. The models and/or algorithms stored in the memory 38 may be dynamic models in that they are updated based on the sensor inputs. The microprocessor 40 may utilize signals from downhole sensors received via line 42 and programs stored in the memory 38. Additionally, the controller 34 may transmit control signals to the injector unit 34 and other flow devices 44, such as flow metering devices, via suitable lines 46.

Figure 2:
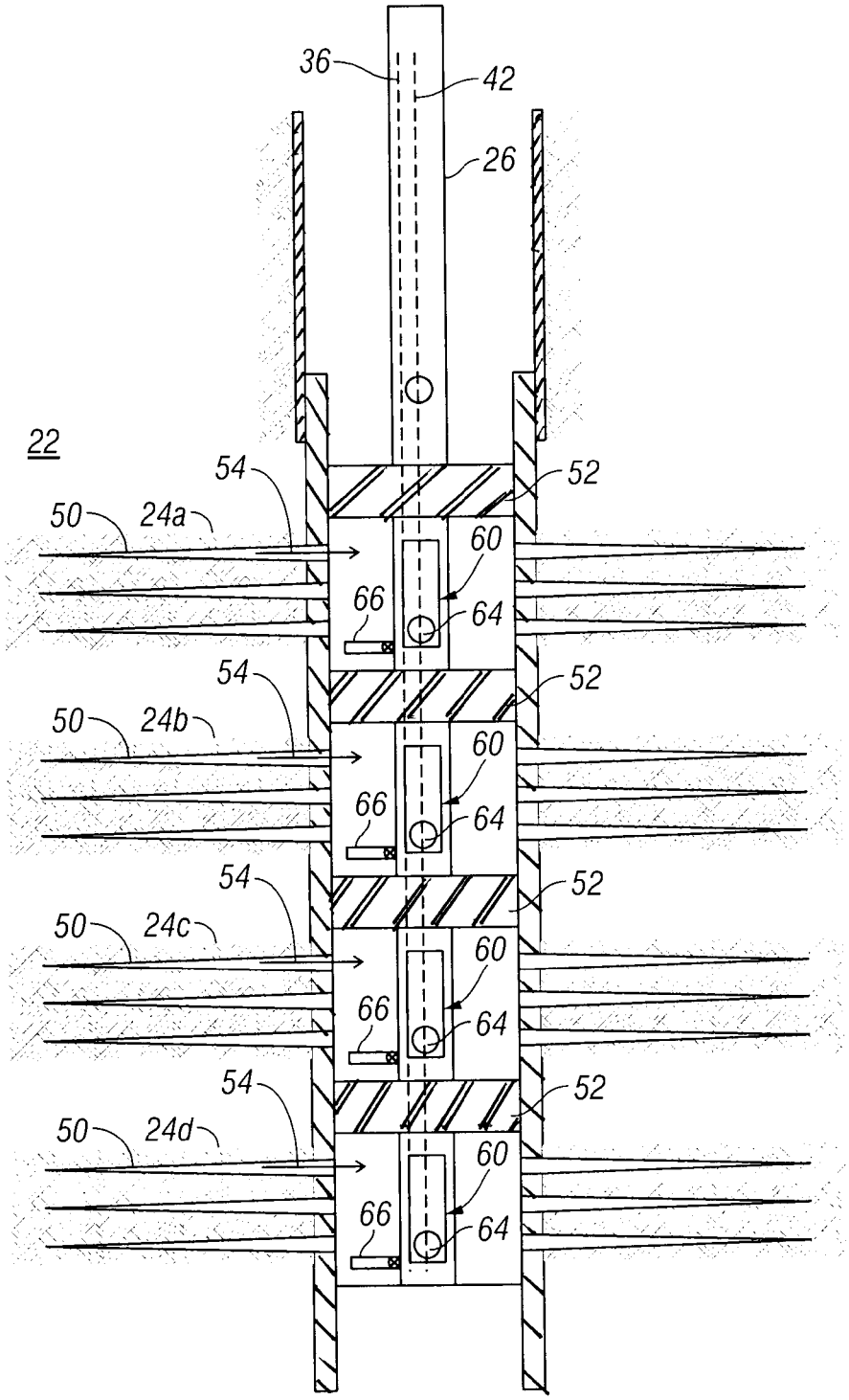
FIG. 2 schematically illustrates one embodiment of the subsurface components of an additive injection and monitoring system made according to the present disclosure.

Referring now to FIG. 2, the wellbore 20 is shown as a production well using conventional completion equipment. The wellbore 20 includes multiple production zones 24A-D, each of which that includes perforations 50 into the formation 22. Packers 52, which may be retrievable packers, may be used to provide zonal isolation for each of the production zones. Formation fluid 54 enters the production tubing 26 in the well 16 via perforations 50. Each zone may include intelligent well completion equipment 60 that may be utilized to independently control flow at each of the zones 24A-D during the life of the well. The equipment may include flow control devices 62 such as valves, chokes, seals, etc. that are configured to adjust, vary and control flow from the formation into the tubing. Additionally, the equipment 60 may be utilized to flow fluid from the tubing into the formation; e.g., to test or treat the zone.

Additionally, the well completion equipment 60 may include sensors 64 that measure parameters that may be useful in determining downhole conditions and determining the effectiveness of the additive being injected into the well. Representative sensors include, but are not limited to, a temperature sensor, a viscosity sensor, a fluid flow rate sensor, a pressure sensor, a sensor to determine chemical composition of the production fluid, a water cut sensor, an optical sensor, etc. Other illustrative sensors include sensors configured to determine a measure of at least one of scale, asphaltenes, wax, hydrate, sulfites emulsion, foam or corrosion.

In embodiments, the well completion equipment 60 at two or more zones may include an injector nozzle 66 that receives an injection fluid from a common umbilical 36. The umbilical 36 may be tubing, pipe, hose or other suitable device for conveying fluid. The injector nozzle 66 may be configured as generally tubular members that direct the injection fluid into an annular region 68 of the zones 24A-D such that the injection fluid mixes with the production fluid 54 and enters the well completion equipment 60 and production tubing 26. The injection fluid thereby treats the surfaces of the well completion equipment 60 and reduces the occurrence and/or magnitude of undesirable conditions such as scale build up, corrosion, etc. In one arrangement, the injector nozzle 66 may be positioned downhole of the perforations 50. Additionally, one-way flow control elements 70, e.g., check valves, may be utilized to ensure that fluid travels in only one direction.

Figure 3:
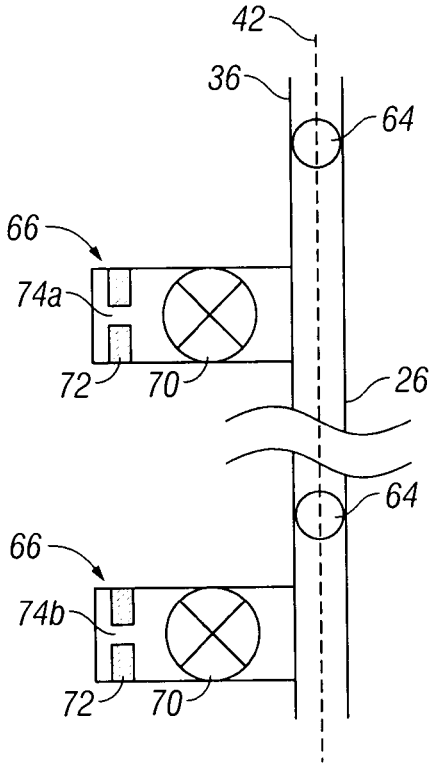
FIG. 3 schematically illustrates one embodiment of injector nozzles made according to the present disclosure.

Referring now to FIG. 3, in certain embodiments, the injector nozzles 66 may be configured to affect, influence or adjust one or more flow parameters for the injection fluids. Illustrative flow parameters include, but are not limited to, pressure differentials and flow rates. In some embodiments, the nozzles 66 may utilize an adjustable device that can control a magnitude, duration and/or frequency of a change to a flow parameter. For example, the nozzle 66 may include one or more elements that are responsive to a signal. The elements may throttle flow by reducing a cross-sectional flow area. Suitable signals include, but are not limited to, electrical signals, magnetic, signals and thermal signals. The elements may provide continuous or intermittent control over a flow parameter. Thus, in a sense, a flow parameter may be modulated.

In other embodiments, the nozzles 66 may utilize a fixed configuration that has a fixed affect on a flow parameter. For example, in one arrangement, each nozzle 66 may include a uniquely or individually configured flow restriction element 72 that allows each nozzle 66 to adjust one or more flow parameters for the fluid being ejected into their respective zones. The flow restriction element 72 may be configured to vary a flow parameter or characteristic such as pressure. For ease of explanation, the flow restriction element 72 is shown as uniquely configured orifices 74A,B. The orifices 74A,B each have different dimensions, which generate different pressure drops across each orifice 74A,B. The use of different pressure drops may be calibrated to ensure that each nozzle 66 dispenses a preset or pre-determined amount of injection fluid. The preset amount may be a specified amount, a minimum amount, a maximum amount or a range. The preset amount may be the same for each nozzle 66 or different for two or more nozzles. For instance, an upper zone may be separated by several hundred feet from a lower zone. Thus, the orifice for the nozzle at the upper zone may be smaller than the orifice for the nozzle at the lower zone to ensure that roughly the same amount of injection fluid is supplied into each zone. In other arrangements, the pressure drops may be calibrated to ensure that each nozzle 66 dispenses a different amount of injection fluid at each zone. It should be understood, therefore, that depending on a particular application, the flow restriction elements 72 may all have the same configuration, may include two or more elements of the same configuration, or may all have different configurations. Furthermore, the particular configuration for the nozzles may depend on the desired flow regime to be imposed on the injection fluid and/or the production flow at each zone.

It should be appreciated that orifices are only illustrative of flow restriction elements that may be utilized in connection with the present disclosure. For example, in certain embodiments, a valve having an adjustable or configurable biasing element may be utilized to selectively restrict fluid flow. The spring force or power rating of the biasing element, which may be a spring element, may be varied to control or restrict fluid flow.

Figure 4A:
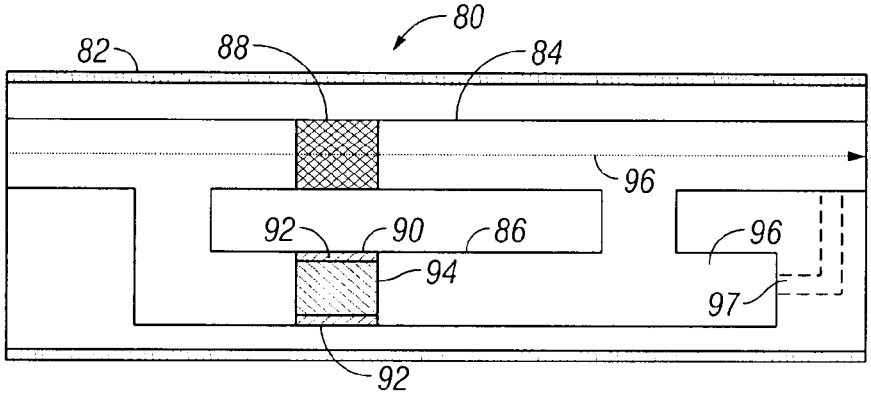
FIGS. 4A and 4B schematically illustrate a filter according to one embodiment of the present disclosure.
Figure 4B:
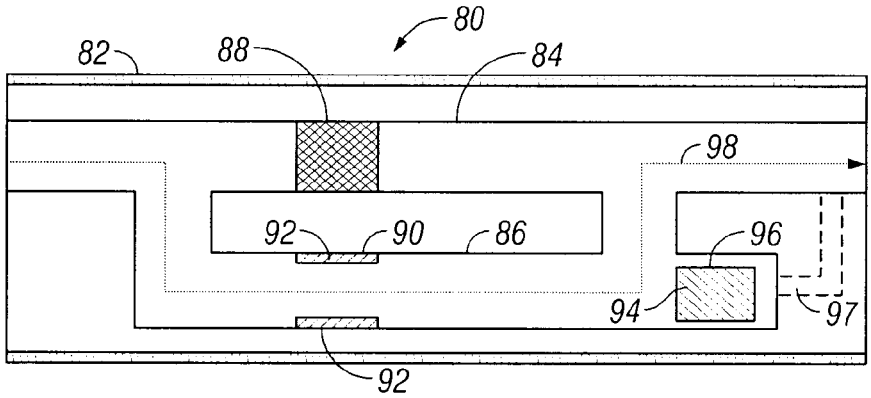

Referring now to FIGS. 4A & B, there is shown an illustrative flow filtering device 80 that may be utilized along the umbilical 36 (FIG. 2) to remove particulates from the injection fluid that could otherwise clog the flow restriction elements 72 (FIG. 3). The filtering device 80 may be distributed along the umbilical 36; e.g., at each production zone. In one embodiment, the filtering device includes a housing 82 in which are formed a first conduit 84 and a second conduit 86. The conduits 84, 86 may be configured to convey fluid flow across the housing 82 in a parallel fashion. The first conduit 84 may include a filter element 88 that is configured to remove particles larger than a specified size from the injection fluid. The filter media may include a spun filter, a woven filter, a mesh, screen, etc. The second conduit 86 may include a pressure activated occlusion member 90 that is displaced upon the application of a predetermined pressure or pressure differential. In one embodiment, the occlusion member 90 may include frangible elements 92 that connect to and hold stationary a piston-type head 94. The piston head 94 may be configured to seal off or block flow in the second conduit 86. During operations, injection fluid flows through along the first conduit 84 and through the filter element 88. An exemplary flow path is shown with line 96. The piston head 94 blocks flow across the second conduit 86. Referring now to FIG. 4B, particles or debris removed by the filtering element 88 may accumulate to a point where flow across the filtering element 88 is substantially reduced. This reduced flow may increase the upstream pressure in the conduits 84 and 86. Once the pressure reaches a predetermined level, the frangible elements 92 break and release the piston head 94. The piston head 94 translates or slides along the conduit 86 and seats within a cavity 96 in a manner that the conduit 86 is not occluded or otherwise blocked. A passage 97 may be used to evacuate or drain the cavity 96 as the piston head 94 enters the cavity 96. Thus, the injection fluid bypasses the filter element 88 by flowing through the second conduit 86. It should be appreciated when several flow filtering devices 80 are serially aligned along the umbilical, each may be successively bypassed. An exemplary bypass flow path is shown with line 98.

It should be appreciated that the filtering device may be susceptible to numerous variations and modifications. For example, the filtering device 80 may connect to the umbilical 36 via suitable connections. To enable the testing of pressure in the filtering device 80 and/or the testing of pressure in the umbilical 36 above and/or below the device 80, pressure testable connections may be provided at or near the connections between the filtering device 80 and the umbilical 36. Additionally, in certain embodiments, a filtering device 80 may be configured such that a single supply line is split into two or more downstream exit lines. The exit lines may feed nozzles downhole or may connect to an outlet having a valve, a back check device or other such device. Additionally, the filtering device 80 may incorporate a back check to ensure fluid flows in a desired direction; i.e., prevent back or reverse flow. In certain variants, a filtering device may use two or more filter elements 94. The filter elements 94 may be arranged in a serial or parallel fashion. In an illustrative serial arrangement, several filter elements are configured to have successively smaller filtering passages. Thus, for instance, a filter element closest to an inlet may have openings that block the passage of particles larger than a predetermined size. Each successive filter element may have smaller openings to trap successively smaller particles. Such an arrangement may be used to delay the pressure build-up that activates the pressure activated occlusion member 90.

Referring now to FIGS. 1-4, the system 10 may be operated in a number of modes. In embodiments, the controller 34 may control the operation of the injector unit 32 by utilizing programs or algorithms stored in a memory 38 associated with the controller 34. The microprocessor 40 utilizes signals from the sensors 64 to determine the appropriate amount of additive(s) to be dispensed into the wellbore. For example, the controller 34 may be programmed to alter the pump speed, pump stroke or air supply to deliver the desired amount of the injection fluid. The pump speed or stroke, as the case may be, is increased if the measured amount of the additive injected is less than the desired amount and decreased if the injected amount is greater than the desired amount. Exemplar modes, which may be utilized concurrently, are discussed below.

In one mode of operation, the controller 34 may receive signals from one or more pressure sensors 64 that are distributed along the umbilical 36. The pressures sensors 64 may provide a measurement of the pressure drop at each nozzle 66 and also at a location upstream of all the nozzles 66. Thus, the controller 34 may utilize algorithms to determine the flow rate of the injection fluid at each nozzle. Based on this determination, if needed, the processor 34 may revise the concentration of additives, vary the mixture of additives, vary the flow rates of the injection fluid, or take some other corrective action.

In another mode of operation, the controller 34 may receives signals from one or more sensors 64 indicative of a parameter of interest which may relate to a characteristic of the produced fluid. The parameters of interest may relate, for example, to environmental conditions or the health of equipment. Representative parameters include but are not limited to temperature, pressure, flow rate, a measure of one or more of hydrate, asphaltene, corrosion, chemical composition, wax or emulsion, amount of water, and viscosity. Based on the data provided by the sensors, the controller 34 may determine the appropriate amount of one or more additives needed to maintain a desired or pre-determined flow rate or other desired condition.

Thus, it should be appreciated that what has been described includes, in part, a system that may periodically monitor the actual amounts of one or more additives being dispensed, determine the effectiveness of the dispensed additives, at least with respect to maintaining certain parameters of interest within their respective predetermined ranges, determine the health of the downhole equipment, such as the flow rates and corrosion, determine the amounts of the additives that would improve the effectiveness of the system, and then initiate one or more actions that cause the system to dispense additives according to newly computed amounts. In embodiments, the system may automatically take a broad range of actions to assure proper flow of hydrocarbons through production tubing, completion equipment, and/or surface pipelines to minimize the formation of scales, hydrates, asphaltenes, etc. Also, in embodiments, the system may be closed loop in nature and respond to the in-situ measurements of the characteristics of the treated fluid and the equipment in the fluid flow path.

It should be appreciated that what has been described also includes, in part, a system that may include an umbilical to convey the injection fluid in a well; a plurality of nozzles that receive the injection fluid from the umbilical; and a flow control element associated with each nozzle. Each flow control element may control a flow of the injection fluid through the associated nozzle. In arrangements, each flow control element may restrict a flow of the injection fluid through the associated nozzle to cause each nozzle to eject a preset amount of injection fluid. In some configurations, each nozzle may eject substantially the same amount of injection fluid. In embodiments, the flow control elements may include an orifice. Also, in arrangements, at least two flow control elements may have different sized orifices. In certain configurations, the system may further include a plurality of pressure sensors disposed along the umbilical; an injector unit configured to dispense fluid into the umbilical; and a controller operatively coupled to the injector unit, the controller being configured to operate the injector in response to measurements from the pressure sensors. Additionally, at least one filter may be positioned in the umbilical. In such arrangements, the filter(s) may be positioned in the first conduit and an occlusion member that restricts flow in a second conduit. The occlusion member permits flow in the second conduit, which is parallel to the first conduit, after a predetermined pressure differential exists in the second conduit.

It should be appreciated that what has been described further includes, in part, a method that may include conveying the injection fluid into the well using an umbilical; ejecting the injection fluid into the well using a plurality of nozzles; and controlling the flow of the injection fluid through each nozzle using a flow control element associated with each nozzle. The method may further include restricting a flow at each nozzle to cause each nozzle to eject a preset amount of injection fluid. The method may also include ejecting substantially the same amount of injection fluid from each nozzle. The flow control elements may include an orifice. Also, at least two flow control elements may have different sized orifices. In applications, the method may also include disposing a plurality of pressure sensors along the umbilical; dispensing the injection fluid into the umbilical using an injector unit; and controlling the injector unit using a controller configured to operate the injector in response to measurements from the pressure sensors. In arrangements, the method may include filtering the injection fluid in the umbilical. In certain arrangements, the method may also include forming a first and second conduit along the conduit, wherein the injection fluid is filtered in the first conduit; restricting flow in the second conduit using an occlusion member; and displacing the occlusion member to increase flow in the second conduit after a predetermined pressure differential exists in the second conduit.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A system for injecting an injection fluid in a well, comprising:

a production tubing disposed in the well configured to receive production fluids;

an umbilical disposed in the well, the umbilical being configured to convey the injection fluid from a surface location into the well;

a plurality of nozzles configured to receive the injection fluid from the same umbilical and inject the injection fluid into the production fluids received by the production tubing; and a plurality of flow restriction elements, each flow restriction element being associated with a nozzle of the plurality of nozzles, each flow restriction element being configured to control a flow of the injection fluid through the associated nozzle.

2. The system of claim 1, wherein each flow restriction element is configured to restrict a flow of the injection fluid through the associated nozzle; wherein each flow restriction element is selected to cause each nozzle to eject a preset amount of injection fluid.

3. The system of claim 2, wherein at least two of the flow restriction elements are sized differently such that each nozzle associated with the at least two of the flow restriction elements ejects substantially the same amount of injection fluid.

4. The system of claim 2, wherein each flow restriction element includes an orifice.

5. The system of claim 4, wherein at least two flow restriction elements have different sized orifices and wherein each associated nozzle ejects substantially the same amount of injection fluid.

6. The system of claim 1, further comprising:

a plurality of pressure sensors disposed along the umbilical;

an injector unit configured to dispense fluid into the umbilical; and a controller operatively coupled to the injector unit, the controller being configured to operate the injector in response to measurements from the pressure sensors.

7. The system of claim 1, further comprising:

at least one filter positioned in the umbilical.

8. The system of claim 7, further comprising:

a first and second conduit formed along the umbilical, wherein the at least one filter is positioned in the first conduit; and an occlusion member configured to restrict flow along the second conduit, the occlusion member being further configured to permit flow in the second conduit after a predetermined pressure differential exists in the second conduit.

9. The system of claim 1, wherein the umbilical is positioned outside of the production tubing.

10. The system of claim 1, wherein the umbilical is configured to convey injection fluid to a plurality of production zones.

11. A method for injecting an injection fluid in a well, comprising:

conveying the injection fluid from the surface into the well using an umbilical;

conveying a production fluid out of the well using a production tubing;

ejecting the injection fluid into production fluid in the well using a plurality of nozzles that receives the injection fluid from the same umbilical; and controlling the flow of the injection fluid through each nozzle using a plurality of flow restriction elements, each flow restriction element being associated with a nozzle of the plurality of nozzles.

12. The method of claim 11, further comprising restricting a flow at each nozzle using the associated flow restriction element; wherein the restrictions of flow cause each nozzle to eject a preset amount of injection fluid.

13. The method of claim 12, further comprising causing a different flow restriction at at least two flow restriction elements while ejecting substantially the same amount of injection fluid from each nozzle associated with the at least two flow restriction elements.

14. The method of claim 12, wherein each flow restriction element includes an orifice.

15. The method of claim 14, wherein at least two flow restriction elements have different sized orifices and further comprising ejecting substantially the same amount of injection fluid from each associated nozzle.

16. The method of claim 11, further comprising:

disposing a plurality of pressure sensors along the umbilical;

dispensing the injection fluid into the umbilical using an injector unit; and controlling the injector unit using a controller configured to operate the injector in response to measurements from the pressure sensors.

17. The method of claim 11, further comprising:

filtering the injection fluid in the umbilical.

18. The method of claim 17, further comprising:

forming a first and second conduit along the umbilical, wherein the injection fluid is filtered in the first conduit;

restricting flow in the second conduit using an occlusion member;

displacing the occlusion member to increase flow in the second conduit after a predetermined pressure differential exists in the second conduit.

* * * * *